US007261164B2

(12) United States Patent
Hollier

(10) Patent No.: US 7,261,164 B2
(45) Date of Patent: Aug. 28, 2007

(54) FLOATABLE DRILL CUTTINGS BAG AND METHOD AND SYSTEM FOR USE IN CUTTINGS DISPOSAL

(75) Inventor: Glynn Hollier, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/037,846

(22) Filed: Jan. 18, 2005

(65) Prior Publication Data

US 2005/0252685 A1 Nov. 17, 2005

Related U.S. Application Data

(60) Provisional application No. 60/538,810, filed on Jan. 23, 2004.

(51) Int. Cl.
*E21B 29/12* (2006.01)

(52) U.S. Cl. ..... 166/356; 175/66; 405/210

(58) Field of Classification Search ..... 175/5, 175/7, 66, 206, 207; 405/128, 210; 166/357, 166/356

See application file for complete search history.

(56) References Cited

U.S. PATENT DOCUMENTS

| | | | | |
|---|---|---|---|---|
| 3,552,131 | A | 1/1971 | Mott et al. | 61/46 |
| 3,693,733 | A | 9/1972 | Teague | 175/66 |
| 3,815,673 | A | 6/1974 | Bruce et al. | 160/0.5 |
| 3,891,037 | A | 6/1975 | Well et al. | 175/6 |
| 4,030,216 | A | 6/1977 | Willums | |
| 4,149,603 | A | 4/1979 | Arnold | 175/7 |
| 4,291,772 | A | 9/1981 | Beynet | 175/5 |
| 5,129,469 | A * | 7/1992 | Jackson | 175/66 |
| 5,820,300 | A | 10/1998 | Sonoda et al. | 405/210 |
| 5,878,814 | A | 3/1999 | Breivik et al. | 166/267 |
| 5,899,637 | A | 5/1999 | Blanchard et al. | 405/210 |
| 5,961,438 | A * | 10/1999 | Ballantine et al. | 588/250 |
| 6,119,779 | A * | 9/2000 | Gipson et al. | 166/267 |
| 6,276,456 | B1 * | 8/2001 | Head | 166/359 |
| 6,345,672 | B1 | 2/2002 | Dietzen | 175/66 |
| 6,718,900 | B2 | 4/2004 | Carter | 114/257 |
| 6,796,379 | B1 | 9/2004 | Martin | 166/356 |
| 2003/0230409 | A1 * | 12/2003 | Guesnon et al. | 166/335 |

FOREIGN PATENT DOCUMENTS

| | | |
|---|---|---|
| GB | 2284629 | 6/1995 |
| GB | 2371821 | 3/2001 |
| WO | WO03/080991 | 10/2003 |

* cited by examiner

*Primary Examiner*—Thomas A Beach
(74) *Attorney, Agent, or Firm*—Madan, Mossman & Sriram, P.C.

(57) ABSTRACT

In aspects, embodiments of the present invention provide devices, systems and methods for managing cuttings formed during drilling of a subsea wellbore. By managing, it is meant the processing, storage, transportation and disposal of the cuttings. In an exemplary application, an offshore rig adapted to drill the wellbore uses one or more a selectively buoyant containers to transport the cuttings. The containers are positioned adjacent the offshore rig. In one arrangement, the containers are submerged to a selected depth below the water's surface. A transfer unit flows the cuttings from the offshore rig to the container via a conduit connected to the container.

37 Claims, 2 Drawing Sheets

FLOATABLE DRILL CUTTINGS BAG AND METHOD AND SYSTEM FOR USE IN CUTTINGS DISPOSAL

CROSS-REFERENCE TO RELATED APPLICATIONS

This application claims priority to U.S. provisional patent application Ser. No. 60/538,810 filed on Jan. 23, 2004, titled "Floatable Drill Cuttings Bag and Method and System for Use in Cuttings Disposal."

BACKGROUND OF THE INVENTION

1. Field of the Invention

This invention relates to devices and methods for the collection, storage and disposal of drill cuttings, particularly during offshore drilling operations.

2. Description of Related Art

During a drilling operation, drill cuttings and rock are scraped out of the formation being drilled by a drill bit. The cuttings are then circulated to the surface as drilling mud returns up the annulus of the wellbore. The cuttings are commonly separated from the drilling mud by devices such as shale shakers fitted on the drilling rig. The shakers capture the cuttings and large solids from the drilling fluid during the circulation thereof. A screen is fitted on each shale shaker of certain mesh size and is vibrated to facilitate separation of the majority of fluids from the solids.

Handling of the drill cuttings following separation is a significant problem, particularly in offshore drilling, where space on a drilling rig is limited. More generally, this limited space can create difficulties in conveying and storing other materials at the drilling rig.

SUMMARY OF THE INVENTION

The invention provides improved methods and systems for handling, containment, storage, and haulage of liquids and solids-liquids mixtures such as drill cuttings, base oil, brines, drilling mud, potable water to and from a rig site.

In one aspect, embodiments of the present invention provide devices, systems and methods for managing cuttings formed during drilling of a subsea wellbore. By managing, it is meant the recovery, processing, storage, transportation and disposal of the cuttings. In an exemplary application, an offshore rig adapted to drill the wellbore uses one or more a selectively buoyant containers to transport the cuttings. The containers are positioned adjacent the offshore rig. In one arrangement, the containers are submerged to a selected depth below the water's surface. A transfer unit flows the cuttings from the offshore rig to the container via a conduit connected to the container.

In accordance with one embodiment of the invention, cuttings are conveyed from the shaker assembly off of the rig by a transfer mechanism and are received within one or more of the containers. In one embodiment, the containers are submersible flexible bags that include one or more storage compartments and flotation chambers. The bags can be anchored to a stationary location such the sea floor and provided with buoys to mark their location. Other suitable locations can include the rig itself, an adjacent facility, or vessel. Sensors positioned in the system can be used to determine the buoyancy condition of the bags. For example, the weight of each of the bags can be monitored by sensors and the buoyancy of the bags is controlled in order to ensure that the bag(s) remain neutrally buoyant during filling operations. The storage bags may be removed from the vicinity of the drilling rig by towing and brought to a remote location for unloading and further processing.

In another aspect, the present invention provides methods, devices and systems for conveying a selected material to and from an offshore facility. An exemplary device includes a selectively buoyant container having one or more compartment for storing a selected material such as drill cuttings, base oil, brines, drilling mud, and potable water. The container in one embodiment is a flexible bag adapted to be positioned adjacent a floating facility in a submersed or semi-submersed state.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF DRAWINGS

For a thorough understanding of the present invention, reference is made to the following detailed description of the preferred embodiments, taken in conjunction with the accompanying drawings in which like reference characters designate like or similar elements throughout the several figures of the drawing.

DETAILED DESCRIPTION OF THE INVENTION

Figure 1:
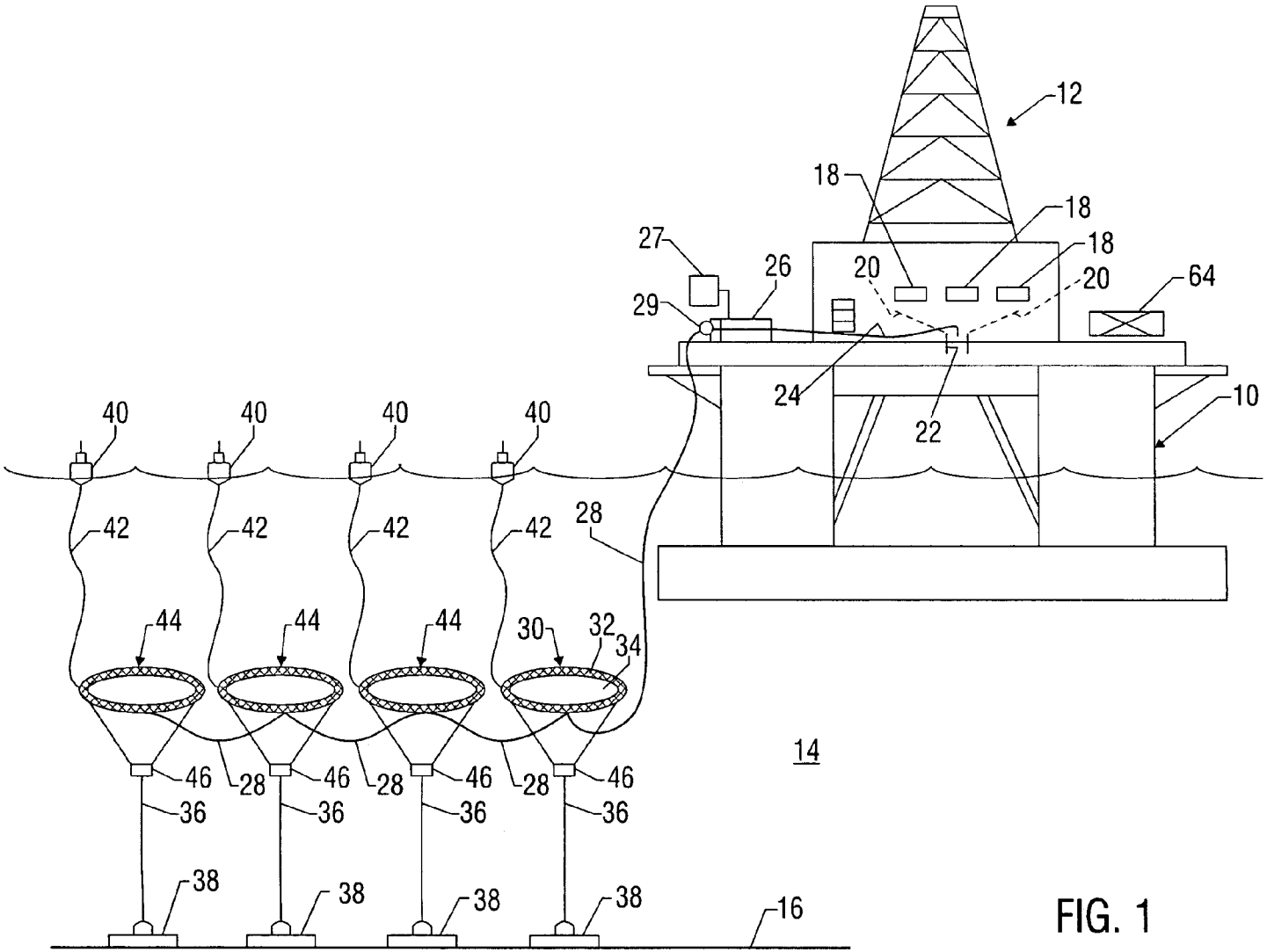
FIG. 1 is a schematic view of an exemplary offshore drilling rig utilizing a drill cuttings collection and disposal system in accordance with the present invention.

FIG. 1 shows an exemplary offshore drilling platform 10 that supports a drilling rig, generally indicated at 12. The drilling platform 10 is depicted as a platform that floats in the sea 14, but may also be a tension leg platform or one in which the platform itself has footings that are landed in the sea floor 16. The drilling platform 10 also supports several shale shakers 18 that receive drill cuttings from the drilling rig 12, in a manner that is known in the art. As is known, during drilling, a drill bit (not shown) disintegrates an earthen formation. The disintegrated formation are generally referred to as cuttings and can include rock, earth and other such materials. The cuttings captured on the screens of the shakers 18 gravity flow into sloping ditch arms 20 into retaining area 22. The cuttings are moved from the retaining area 22 by a conveyor 24 that transports the cuttings to a drill cuttings transfer unit 26. The conveyor 24 may be a moving screw conveyor or a vacuum, auger, or solids progressive cavity pump. Additionally, a reciprocating pump or dense phase pneumatic blower may be used. The transfer unit 26 drives the conveyor 24 and may be located on the drilling platform 10, as shown, or fitted on jackup, platform, workover, drillship, or a separate semi submersible drilling platform. The transfer unit 26 transmits the cuttings through a flexible conduit 28 (typically 4" to 6" in diameter) to a storage bag 30.

In one embodiment, the storage bag 30 is a flexible container that holds a pre-determined quantity of a material at or below the water's surface. By flexible, it is meant that the bag 30 can deform to accommodate the material. This deformation can include bending, expanding, and/or contracting. Also, in addition to drill cuttings, the material can include slurries, water, drilling fluids and other liquids or solid-liquid mixtures. The storage bag 30 is substantially fluid-tight to prevent leaking of the contents. Additionally, the storage bag 30 is formed or relatively rugged material adapted to withstand extended exposure to the ocean environment and to withstand submerged or surface towing. The storage bag 30 includes a central storage chamber 32 into which the cuttings are received from the conduit 28. Additionally, the bag 30 includes one or more flotation chambers 34 that allow the bag 30 to buoyantly float in the sea 14. The bag 30 is secured by a tether 36 to an anchor 38 that rests upon the sea floor 16. The tether 36 can have an adjustable length to accommodate different water depths. In this manner, the bag 30 is maintained in position with respect to the floating platform 10. A buoy 40 is secured by a line 42 to the bag 30 in order to mark the position of the bag 30. Additional bags 44 are positioned alongside the storage bag 30. These bags 44 are each provided with a tether 36, anchor 38, and buoy 40 in the same manner as for the bag 30. As can be seen from FIG. 1, the conduit 28 is interconnected with each of the multiple bags 30 and 44 so that each of the bags 30, 44 may be filled by the conduit 28. Associated with the conduit 28 is a valving system (not shown) that selectively opens and closes valves that permit cuttings to flow into each individual bag. The valving system can be controlled by the controller 48 (discussed below) to provide for such filling.

Figure 2:
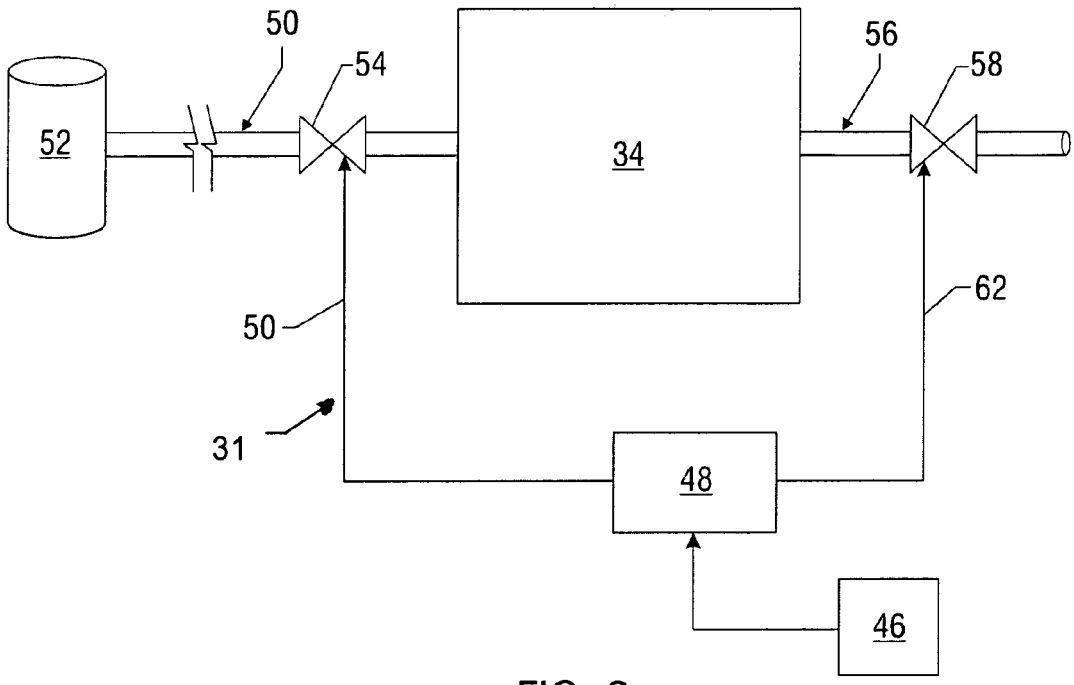
FIG. 2 depicts an exemplary ballast control system for floatable drill cuttings bag.

Referring now to FIGS. 1 and 2, in one embodiment, a ballast control unit 31 controls the buoyancy of the bag 30. An exemplary ballast control unit 31 can include one or more sensors for determining the state of buoyancy of the bag 30, a control unit 48, an air supply line 50, and an air supply 52. It should be appreciated that lighter-than-water buoyant fluids other than air can also be used to provide buoyancy. Additionally, buoyant material such as foam can also be used to provide a preset amount of buoyancy for the bag 30.

In one arrangement, a load cell sensor, shown schematically at 46 in FIG. 1, can be incorporated into the tether assembly 36 to sense the strain placed upon the tether from buoyancy of the bag 30. Load sensors of this type and other types are known in the art for detecting and measuring tensional strain on a line or cable. Other sensor arrangements, such as sensors that measure pressure or depth, can also be used in suitable applications.

As illustrated in FIG. 2, data supplied by the load cell sensor 46 or other type of sensor is used by a controller 48 to control and adjust the buoyancy of the bag 30. The flotation chamber (or chambers) 34 of the bag 30 is connected to the air supply line 50 to add air to the flotation chamber 34 and make it more buoyant. The air supply line 50 is interconnected to the air source 52 and includes a fluid control valve 54 that can be actuated to selectively transmit air from the air source 52 into the flotation chamber 34. Additionally, the flotation chamber 34 is provided with an air outlet 56 having release valve 58 for the selective removal of air from the flotation chamber 34. Control lines 60, 62 are provided from the controller 48 to the fluid control valve 54 and release valve 58.

The controller 48 preferably comprises a programmable logic controller (PLC) that receives data relating to the measured strain from the load cell sensor 46 and, in response, controls the buoyancy of the bag 30. The controller 48 is preferably preprogrammed to maintain the bag 30 at a predetermined depth within the sea 14. If the tension on the tether assembly 36 detected by the load cell sensor 46 is positive, this will indicate that the bag 30 has positive flotation. However, if there is excess tension detected (i.e., tension that exceeds a predetermined amount that is programmed into the controller 48), the controller 48 will release air from the flotation chamber 34 via control line 62 to actuate release valve 58. If, however, there is no tension detected on the tether assembly 36 by the load cell sensor 46, this will indicate that the bag 30 does not have positive flotation. The controller 48 will cause the fluid control line 60 to open and admit additional air into the flotation chamber 34, thereby causing the bag 30 to become more buoyant. The controller 48 may be preprogrammed to iteratively control the buoyancy of the bag 30 during filling so that a substantially constant floating depth is provided. For example, the controller 48 can be programmed to keep the bag 30 neutrally buoyant, positively buoyant, or negatively buoyant.

An amphibious remotely operated vehicle (ROV), schematically shown at 64 in FIG. 1, of a type known in the art, may be used to service the bags 30, 44, such as by connecting or disconnecting the conduit 28 or tethers 36 or lines 42. Alternatively, divers might be used for this purpose.

In operation of the cutting handling and disposal method of the present invention, liquid is initially separated from the cuttings by the shakers 18. Separated cuttings are then transported via conveyor 24 to the transfer unit 26 and, from there into the conduit 28 to the bag 30. The transfer unit 26 can include one or more pumps for flowing the cuttings to the bag 30. In one arrangement, the transfer unit 26 is controlled by a control unit 27 that can include programs to control the pumping process. For example, the control unit 27 and adjusting the pump rate in response to measurements from a sensor such as sensor 46 or other sensors 29 measure one or more parameters of interest such as pressure, flow rate, temperature, etc. The first bag 30 is filled with drill cuttings while the controller 48 monitors the buoyancy of the bag 30 and ensures its flotation at a particular depth. When the first bag 30 is filled to capacity with cuttings, subsequent bags 44 are then filled. In order to do this, the ROV 64 disconnects the conduit 28 from the first bag 30 and connects it to an inlet for one of the other bags 44 so that it may be filled in the same way. During this operation, the transfer unit 26 stops pumping cuttings through the conduit 28. In some applications, simultaneous filling of multiple bags may be accomplished by appropriately programming the controller 48 and utilizing additional flow lines.

In one embodiment, the conduit 28 is formed with multiple bores or channels for conveying one or more materials from the transfer unit 26 to the bag 30. In one arrangement, the conduit 28 can include bores for separately conveying one more liquids, gases, solids, or mixtures. For example, one bore can be adapted to convey the cuttings and another bore can be adapted to convey air. In another arrangement, a bore can be adapted to convey two or more materials either simulataneously or sequentially. In still other arrangements, the bores can provide bidirectional movement of the material. For example, solids or other materials can be conveyed from the bag 30 to the rig 12 as well as from the rig 12 to the bag 30. Additionally, the conduit 28 can include conductors for conducting power (e.g., electrical power, pressurized hydraulic fluid, etc.) and data signals.

Figure 3:
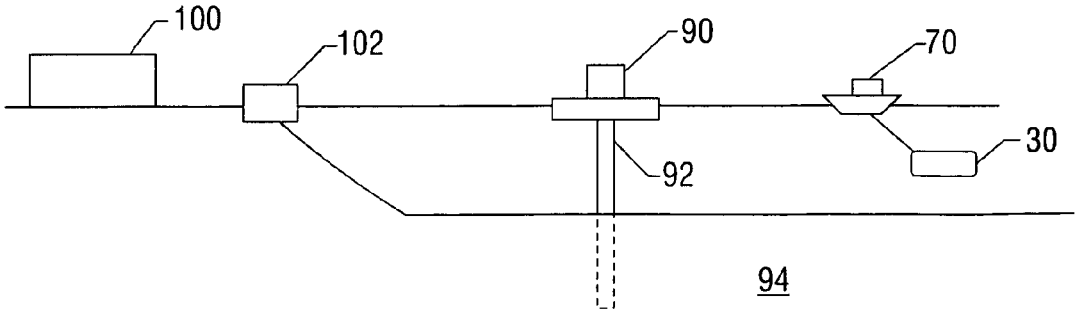
FIG. 3 is a schematic depiction a submersible floating bag filled with cuttings being towed to a facility for processing and disposal.

It should be appreciated that the teachings of the present invention also include the processing and disposal of the cuttings. Referring now to FIG. 3, there is shown a barge 70 towing a bag 30 that has been filled with cuttings. The destination of the bag 30 can be an offshore disposal facility 90 or a land-based disposal facility 100. In mode of operation, the bag 30 is towed to the offshore facility 90. The contents of the bag 30 can be removed by methods such as vacuuming or physically tipping the bag 30. The removed contents are processed as needed to meet environmental regulations and injected via a tubular 92 into a subterranean formation 94 suited to store the processed cuttings. In another mode of operation, the bag 30 is towed to a port or dock 102 wherein the contents are removed and taken to the land-based processing facility 100 for processing and disposal.

It should be appreciated that the above-described embodiments are merely exemplary of the teachings of the present invention and that numerous modifications and variations can be made. For example, the bags 30, 44 can rest upon the sea floor 16 during filling operations rather than floating above it. Moreover the bags 30, 44 can be connected to a relatively stationary location such as the rig or an adjacent facility or vessel. Additionally, any number of bags 30 may be used, not merely the quantity shown in the Figures.

In still other embodiments, the bags 30 can be used as a container to transport materials such as base oil, brines, drilling mud, potable water, and chemical additives. These materials can be conveyed into the bags and towed at or below the water's surface. Moreover, these materials can be tethered adjacent a facility and act as a temporary storage container. It should be appreciated that the bags 30 provide a 154-36748-US convenient method of transporting drilling mud, potable water, and other fluids used to support operations at an offshore hydrocarbon recovery facility.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. An apparatus for conveying a selected material through a body of water, the selected material being supplied from a floating facility, the floating facility further supplying a buoyant material, comprising:

a selectively buoyant container having at least one compartment for storing the selected material and at least one floatation chamber for receiving the buoyant material, the container being adapted to be positioned adjacent the floating facility a source supplying buoyant material positioned proximate to the floating facility;

a conduit connected to the container, the conduit having a first bore conveying the selected material to the container and a second bore conveying the buoyant material to the container, the first bore extending between the buoyant container and a transfer unit on the floating facility, the second bore connected to the source supplying buoyant material;

a ballast control unit adjusting the buoyancy of the container;

a tether connecting the container to a stationary location;

a tension sensor measures tension in the tether; and controller controlling the ballast control unit in response to the measured tension.

2. The apparatus according to claim 1 wherein the ballast control unit adjusts the buoyancy of the container by admitting the buoyant material into the container.

3. The apparatus according to claim 1 wherein the controller controls the ballast control unit in response to one of: (a) a measured positive tension, and (b) no measured tension.

4. The apparatus according to claim 1 wherein the controller is programmed to maintain the container at a substantially neutrally buoyant condition as the selected material flows into the container.

5. The apparatus according to claim 3 wherein the controller controls the ballast control unit to release buoyant material from the container in response to a predetermined positive tension.

6. The apparatus according to claim 1 wherein the bores of the conduit carry materials substantially simultaneously.

7. The apparatus according to claim 1 further comprising a control unit operatively coupled to the transfer unit, the control unit controlling the transfer unit to thereby control the flow of the selected material into the compartment.

8. The apparatus according to claim 1 wherein the selected material is at least cuttings formed during drilling of a wellbore.

9. The apparatus according to claim 1 wherein the container comprises a flexible bag.

10. The apparatus according to claim 1 wherein the container includes a plurality of compartments.

11. The apparatus according to claim 1 wherein the selected material is selected from a group consisting of (i) drill cuttings, (ii) base oil, (iii) brines, (iv) drilling mud, and (v) potable water.

12. A system for managing cuttings formed during drilling of a subsea wellbore, comprising:

(a) an offshore rig adapted to drill the wellbore and return the cuttings to a selected location;

(b) a selectively buoyant container positioned adjacent the offshore rig, the container storing the cuttings from the offshore rig in at least one compartment, and a buoyant material into at least one floatation chamber;

(c) a source supplying buoyant material positioned proximate to the offshore rig;

(d) a conduit connected to the container for conveying the cuttings to the container, the conduit having a first bore conveying the selected material to the container and a second bore connected to the source and conveying a buoyant material to the container from the source supplying buoyant material, the first and second bores each extending between the buoyant container and the floating facility;

(e) a transfer unit adapted to convey the cuttings from the offshore rig to the container via the conduit;

(f) a ballast control unit adjusting the buoyancy of the container;

(g) a tether connecting the container to a stationary location;

(h) a tension sensor measures tension in the tether; and (i) controller controlling the ballast control unit in response to the measured tension.

13. The system according to claim 12 wherein the container comprises a ballast control unit adapted to adjust the buoyancy of the container.

14. The system according to claim 13 wherein the controller is programmed to maintain the container at a substantially neutrally buoyant condition while the container is receiving the cuttings.

15. The system according to claim 13 wherein the controller controls the ballast control unit in response to one of: (i) a measure positive tension and (ii) a measured no tension.

16. The system according to claim 15 wherein a sensor measuring the parameter of interest is positioned at one of (i) the container, (ii) a tether connecting the container to a stationary location, (iii) the conduit, and (iv) the transfer unit.

17. The system according to claim 15 wherein the offshore rig includes a processing unit for processing the cuttings before the transfer unit flows the cuttings to the container.

18. The system according to claim 12 wherein the conduit can substantially simultaneously convey at least a buoyant material and the cuttings to the container.

19. The system according to claim 12 further comprising a control unit operatively coupled to the transfer unit, the control unit controlling the transfer unit to thereby control the flow of the cuttings to the container.

20. The system according to claim 12 wherein the container comprises a flexible bag.

21. The system according to claim 12 wherein the container substantially prevents the cuttings from leaking into the body of water.

22. The system according to claim 12 wherein the container is towable, and further comprising a towing vessel adapted to tow the container across the body of water.

23. The system according to claim 12 further comprising an offshore facility adapted to remove the cuttings from the container and inject the cuttings into a subterranean formation.

24. The system according to claim 12 further comprising a land based facility adapted to remove the cuttings from the container and inject the cuttings into a subterranean formation.

25. The system according to claim 12, wherein the tether has an adjustable length.

26. A method for managing cuttings formed during drilling of a subsea wellbore, comprising:

(a) recovering cuttings formed during drilling of the wellbore;

(b) connecting a conduit having a first bore and a second bore between an offshore facility and a selectively buoyant container, the first and second bores each extending between the buoyant container and the floating facility;

(c) conveying the cuttings into the selectively buoyant container positioned adjacent an offshore rig via the first bore using a transfer unit; and (d) connecting a source supplying a buoyant material to the second bore and conveying the buoyant material from the source supplying the buoyant material to the selectively buoyant container using the second bores;

(e) adjusting the buoyancy of the container with a ballast control unit;

(f) connecting the container to a stationary location with a tether;

(g) measuring tension in the tether with a tension sensor; and (h) controlling the ballast control unit in response to the measured tension with a controller.

27. The method according to claim 26 further comprising controlling the ballast control unit with the controller in response to one of: (a) a measured positive tension, and (b) no measured tension.

28. The method according to claim 26 further comprising maintaining the container at a substantially neutrally buoyant condition while the container is receiving the cuttings.

29. The method according to claim 26 wherein the controller controls the ballast control unit to release buoyant material from the container in response to a predetermined positive tension.

30. The method according to claim 26 further comprising processing the cuttings before the transfer unit flows the cuttings to the container.

31. The method according to claim 26 further comprising conveying the cuttings from the transfer unit to the container and conveying the buoyant material to the container substantially simultaneously.

32. The method according to claim 26 further comprising controlling the transfer unit with a control unit to control the flow of the cuttings to the container.

33. The method according to claim 26 wherein the container comprises a flexible bag.

34. The method according to claim 26 wherein the container substantially prevents the cuttings from leaking into the body of water.

35. The method according to claim 26 further comprising towing the container across the body of water with a towing vessel.

36. The method according to claim 26 further comprising removing the cuttings from the container and injecting the cuttings into a subterranean formation.

37. The method according to claim 26 further comprising towing the container to a land based facility for disposal.

* * * * *